United States Patent [19]

Fujita et al.

[11] Patent Number: 4,965,919

[45] Date of Patent: Oct. 30, 1990

[54] POTENTIAL BULKY POLYESTER ASSOCIATED BUNDLES FOR WOVEN OR KNITTED FABRIC AND PROCESS FOR PRODUCTION THEREOF

[75] Inventors: Takayoshi Fujita; Hisao Nishinaka, both of Shiga; Michio Ohota, Osaka; Yoshihisa Dammoto, Osaka; Shigeo Nagira, Osaka, all of Japan

[73] Assignee: Toyo Boseki Kabushiki Kaisha, Osaka, Japan

[21] Appl. No.: 352,208

[22] Filed: May 15, 1989

[30] Foreign Application Priority Data

Aug. 31, 1988 [JP] Japan ..... 63-218941
Aug. 31, 1988 [JP] Japan ..... 63-218942

[51] Int. Cl.[5] ..... D02G 1/18; D02G 1/02; D02G 3/24; D02J 1/08

[52] U.S. Cl. ..... 28/220; 28/271; 28/281; 57/206; 57/238; 57/244; 57/246; 57/247; 57/350; 57/908; 428/373

[58] Field of Search ..... 57/238, 239, 206–209, 57/244–247, 350, 908; 428/373, 374; 28/219, 220, 271, 274–276, 281

[56] References Cited

U.S. PATENT DOCUMENTS 3,549,597 12/1970 Kitson et al. ..... 57/246 X

FOREIGN PATENT DOCUMENTS 55-62240 5/1980 Japan .
56-112537 9/1981 Japan .
60-28515 2/1985 Japan .

*Primary Examiner*—John Petrakes
*Attorney, Agent, or Firm*—Wegner & Bretschneider

[57] ABSTRACT

Potential bulky polyester associated bundles or yarns for woven or knitted fabric include spontaneously heat extensible multi-filament A and heat shrinkable multi-filament B. The associated bundles are interlaced at 20–100 interlaces/m. For multi-filament A, the following physical properties apply: <3 denier as a single bundle; 20–80% denier ratio content in associated bundles, wet shrinkage at 100° C. (SHW (A))=0–5%, dry shrinkage at 160° C. (SHD (A))=−15–0%. The properties pertaining to multi-filament B include: fracture tenacity>4 g/denier, denier ratio of 80–29% content in associated bundles, SHW (B)>5–60%. Additionally, SHD (B)-SHD(A)>5%. The invention also relates to processes for forming the bundles and for weaving the bundles into fabric.

38 Claims, 3 Drawing Sheets

POTENTIAL BULKY POLYESTER ASSOCIATED BUNDLES FOR WOVEN OR KNITTED FABRIC AND PROCESS FOR PRODUCTION THEREOF

FIELD OF THE INVENTION

The present invention relates to polyester associated bundles for silky woven or knitted fabric which are soft and flexible and possess suitable dry touch, proper degree of "hari (stiffness)", "koshi (nerve)" and drape as well as a process for production thereof and a process for production of polyester fabric.

BACKGROUND OF THE INVENTION

Hitherto, polyester multi-filaments have been used for various applications including clothing and industrial raw materials with making the most of their excellent characteristics. As applications for clothing, many companies have studied aiming at obtaining silky feeling as one target. Actually, in a certain field, characteristic feelings which are better than that of silk have been obtained. For example, associated bundles composed of several multi-filaments which have different heat shrinkage characteristics show excellent properties and feelings such as bulge, bulkiness, warm feeling and the like, and have been widely used. However, if all of the multi-filaments which constitute bundles shrink upon heating, it is impossible to maintain sufficient difference in the degree of shrinkage of filaments because of restraint of the construction of knitted or woven fabric, and further knitted or woven fabric is apt to be hardened because of shrinkage of the filaments. In order to solve such problems, "metsuke (weight)" can be reduced to provide shrinkage characteristic, or alkali reduction can be increased to maintain feeling. However, filaments having great heat shrinkage may generally become stiff by heat treatment and, therefore, products having sufficient feeling can hardly be obtained.

On the other hand, composite bundles composed of polyester filaments which extend by heat treatment and filaments which shrink by heat treatment have been known (e.g., Japanese Patent Laid Open Publication Nos. 62240/1980, 112537/1981, 28515/1985 and the like). These provide much softer and more flexible feeling than the above filaments composed of shrinkable filaments alone. However, they have drawbacks. For example, they become slimy because of loops of elongated and protruded filaments, or handling properties in post treatment are deteriorated because of great difference in length of filaments due to heat treatment, which results in split of filaments.

OBJECTS OF THE PRESENT INVENTION

One object of the present invention is to provide potential bulky polyester associated bundles for woven or knitted fabric which are soft and flexible and possess suitable dry touch, proper degree of "hari (stiffness)", "koshi (nerve)" and drape.

Another object of the present invention is to provide a process for production of the associated bundles Still another object of the present invention is to provide a process for production of polyester fabric by using the associated bundles These objectives as well as other objectives and advantages of the present invention will become apparent to those skilled in the art from the following description by referring to the accompanied drawings

SUMMARY OF THE INVENTION

Figure 1:
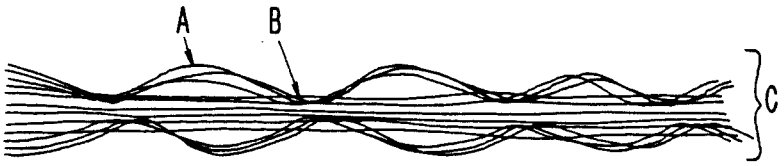
FIG. 1 is a schematic view of the associated bundles of the present invention wherein difference of filaments length is generated upon heat treatment.

As the first aspect of the present invention, there is provided a potential bulky polyester associated bundles for woven or knitted fabric comprising multi-filament A and multi-filament B whose physical properties satisfy the following requirements, said associated bundles being interlaced at a degree of interlacing of 20–100 interlaces/m:

Multi-filament A: not more than 3 denier as a single yarn (content in the associated bundles: 20 –80% [denier ratio]) . (A)

Multi-filament B: multi-filament having breaking tenacity of not less than 4 g/denier (content in the associated bundles: 80–20% [denier ratio]) . . . (B)

| | |
|---|---|
| SHW (A) ≧ 0% | SHD (A) ≦ 0% |
| SHW (B) ≧ 0% | |
| SHD (B)-SHD (A) ≧ 5% | |

in which

SHW: wet shrinkage at 100° C. (%)

SHD: dry shrinkage at 160° C. (%).

As the second aspect of the present invention, there is provided a process for production of potential bulky polyester associated bundles for woven or knitted fabric which comprises subjecting polyester multi-filaments fracture tenacity of drawn multi-filaments: 30–45%, Δn 0.10–0.14) to relaxation heat treatment with a noncontact heater at heater temperature satisfying the following formulas [A]-(1)-and (2) simultaneously at overfeeding ratio of 20–60%, and combining the resulting polyester multi-filaments A and B satisfying the following formula [B]so that the ratio of A/B becomes 20–80% 80 (denier ratio) and then interlacing at degree of interlacing of 20–100 interlacings/m:

V: velocity of relaxation draw-off roll (m/min)

[A] $75 \log(\sqrt{D = V_y}/HL) + 4.7 \sqrt{V_y} \geqq T \geqq$ $$25 \log(\sqrt{D \times V_y}/HL) + 4.7 \sqrt{V_y} \quad (1)$$

$$T \leqq T_m - 10 \quad (2)$$

in which:

D: denier after relaxation $V_y$: velocity of relaxation draw-off roll (m/min)

HL: length of relaxation non-contact heater (m)

$T_m$: melting point (° C.)

$T_g$: second order transition point temperature

| | |
|---|---|
| [B]SHW (A) ≧ 0% | SHD (A) ≦ 0% |
| SHW (B) ≧ 0% | |
| SHD (B)-SHD (A) ≧ 5% | |

in which:

SHW: wet shrinkage at 100° C. (%)

SHD: dry shrinkage at 160° C. (%)

HL: length of relaxation non-contact heater (m)

$T_m$: melting point (° C.)

$T_g$: second order transition point temperature (° C.).

As the third aspect of the present invention, there is provided a process for production of polyester fabric which comprises twisting associated multi-filaments wherein multi-filament (A) having spontaneous extensible characteristic and multi-filament (B) having 160° C. SHD different from that of said multi-filament (A) are interlaced at degree of interlacing of 20–100 interlacings/m, twist setting and/or sizing at a temperature of not higher than 85° C., drying and then weaving fabric with the filaments as warp and/or weft, said multi-filaments satisfying the following formulas:

| | |
|---|---|
| SHW (A) ≧ 0% | SHD (A) ≦ 0% |
| SHW (B) ≧ 0% | |
| SHD (B)–SHD (A) ≧ 5% | |

in which:

SHW: wet shrinkage at 100° C. (%)

SHD: dry shrinkage at 160° C. (%).

DETAILED DESCRIPTION OF THE INVENTION

Hereinafter, the associated bundles of the present invention are explained by using FIG. 1.

FIG. 1 shows a schematic view of one example of the polyester associated bundles of the present invention after the difference in fiber length is generated by heat treatment In FIG. 1, A is a multi-filament mainly constituting a sheath which has been substantially extended by heat treatment at high temperature (multi-filament after self elongation). B is multi-filament constituting a core which has shrunk by heat treatment (multi-filament after heat shrinkage).

Firstly, heat shrinkage characteristic of the constituent multi-filament which is one of most important requirements of the present invention will be explained. Multi-filament·A constituting the polyester associated bundles of the present invention has only slight difference in the degree of shrinkage from that of multi-filament B during production steps such as conventional sizing and shows substantial shrinkage. Consequently, when the same difference in length of filaments is generated in cloth, the bundles themselves hardly show difference in length (bulge, loops and the like), thus they can be much more easily handled and woven during weaving process in comparison with conventional composite filaments having differential shrinkage all of which shrink by heating. That is, when difference in filaments length (loops) is generated in filaments, loops are rubbed against each other during beaming or weaving and are caught on a guide or a comb, which remarkably deteriorates shedding and processability Further, heat treatment such as sizing of conventional heat shrinkable multi-filaments may fix the heat setting, and difference in filaments length greater than that obtained in the initial heat setting is no longer generated by heat treatment at a high temperature of the order of 160 to 180° C. in the final set. On the other hand, in the associated bundles of the present invention containing multi-filaments which shrink in hot water and extend by high temperature treatment corresponding to the final set, multi-filament A protrudes in the form of loops from the surface of the 1 generally shrunk cloth by finishing, providing a soft touch like a surface of a peach. For this purpose, SHW (A) ≧ 0% and SHD (A) ≦ 0% are essential. Further, to provide bulge and bulkiness, SHD (B) − SHD (A) ≧ 5% is essential. When it is below 5%, bulge and bulkiness become insufficient. When it is too large, the protruding from the surface becomes too much, which results in problems during ironing such as brightening. Thus, it is preferably not more than 50%, more preferably 10–35%. For the same reason, SHW (A) is preferably not more than 5% and SHD (A) is not less than −15%.

Elongation at break of multi-filament A should be not less than 50 % to obtain soft feeling. Generally, in order to readily obtain soft feeling in polyester, SHW of the filaments should be smaller and elongation at break should be larger, That is, as explained above, since multi-filaments which form loops and cover the surface of the cloth are spontaneously extensible filaments and touch of such multi-filaments determine that of the cloth, such elongation at break is required. However, when elongation at break is too large, the handling properties are deteriorated. Thus, preferably, elongation at break of multi-filament A is not more than 100%, more preferably, not more than 80%.

Elongation at break of multi-filament B is preferably not more than 40% in order to prevent generation of unevenness of yarns by extension of associated bundles during post treatment such as rewinding, weaving or knitting. Further, in order to prevent problems of abrasion of the products after forming into cloth, elongation at break is more preferably 25–40%. The heat shrinkable multi-filament should have fracture tenacity of at least 4 g/denier because fracture tenacity of the associated bundles depends on that of heat shrinkable multi-filaments, and it should be not less than 20% in terms of denier ratio of the associated bundles. Of course, when fracture tenacity is high, the ratio of multi-filament B may be smaller, but when it is less than 20%, shrinkage of multi-filament B becomes small and a bulge derived from the difference in length of filaments can not be obtained. By the way, SHW and 160° C. SHD of multi-filament B are preferably 5–60% and 5–80%, respectively. More preferably, 5–50% and 5–60%, respectively.

In the present invention, the associated bundles of the present invention may be so-called thick and thin yarns having uneven thickness in the direction of the fiber axis of multi-filament B. In this case, SHW may be 5–30%.

Figure 3:
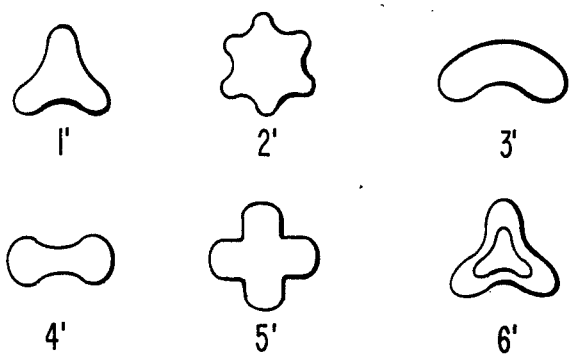
FIG. 3 is schematic cross sections of typical examples of multi-filaments I of the present invention.

Considering retention of physical properties of filaments after processing, the thick and thin yarns preferably have the degree of orientation (Δ n) of 15–60 × $10^{-3}$, more preferably, 20 − 40 × $10^{-3}$ (thin part) and not less than 90 × $10^{-3}$, more preferably not less than 160 × $10^{-3}$ (thick part). Generally, when thick and thin yarns are dyed, they exhibit variable density accompanied with drawbacks such as too excessive difference between light and shade. In the associated bundles according to the present invention, thick and thin yarns can be arranged in inner layer by heat treatment, while multi-filament A is arranged in outer layer. Thus, too strong difference between light and shade of thick and thin filaments can be desirably masked by multi-filament A, providing natural color tone. Like multi-filament A, multi-filament B can have spontaneous extensible characteristic (SHD (B) ≦ 0), but preferably, difference between its SHD and that of multi-filament A, ΔSHD, is not less than 5%. Multi-filament A should be composed of single fibers of not more than 3 denier. When it is more than 3 denier, extensibility at break becomes high, which provides rough feeling even with low Young's modulus. On the other hand, when it is too thin, even in the case of modified cross section filaments as shown hereinafter, "hari" and "koshi" (i.e., degree of resilience and stiffness; properties relating to body and tension) are lost. Accordingly, preferably, the thickness is not less than 0.1 denier. In this case, those over 3 denier can be mixed therein (denier mix) so long as the average is not more than 3 denier. Further, filaments may preferably have modified cross section with at least one indent on the perimeter of the cross section. Particularly, since filaments having high elongation at break such as the associated bundles of the present invention are soft but apt to be slimy, the cross section can be modified to increase contacting points with other filaments and to provide dry touch. The term "modified cross section" used herein means the cross sectional shape having at least one indent on the perimeter of the filament such as triangle, hexagon, oblate, or hollowed form thereof. The typical examples of the cross sectional shape of the single yarn of filament A used in the present invention are shown in FIG. 3 as illustration 1'; 2'; 3'; 4'; 5'; and 6'. To provide such feeling and advantages, these single yarns are preferably composed of not less than 10 filaments.

The associated bundles of the present invention have a substantial sheath-core structure because multi-filaments A are mainly present on the surface layer of the associated bundles to facilitate protruding of loops from the surface of the cloth. The term "substantial sheath-core structure" used herein means not only the structure wherein the associated bundles are clearly divided into the core and the sheath, that is, multi-filaments A and B are clearly separated at a certain interface of the associated bundles, but also the structure wherein both components are mixed throughout the entire associated bundles, particularly, at neighborhood of the boundary surface, and multi-filament B is mainly distributed in the core part and multi-filament A is mainly distributed in the sheath part. The associated bundles of the present invention include those wherein multi-filaments B are distributed in a larger weight ratio than that of multi-filaments A within the area of ⅓ of the radius from the center and multi-filaments A are distributed in a larger weight ratio than that of multi-filaments B within the area of ⅓ of the radius from the surface. In this case, the determination of the sheath-core structure and the denier ratio as described above can be carried out by fixing the associated bundles with epoxy resin, observing the cross section obtained by random cutting (100 times) under a light microscope and determining the average value and the conditions.

Further, the degree of interlacing of 20–100 interlacings/m is required. When the degree of interlacing is less than 20/m, multi-filaments are easily split by the difference of the length, which remarkably deteriorates processability. On the other hand, when the degree of interlacing exceeds 100/m, unevenness due to interlacing becomes prominent in cloth and mon-filaments of multi-filaments A are apt to be undesirably broken to become fluff.

The cross section of multi-filament B constituting inner layer is not specifically limited However, hollow yarn is preferable to impart bulkiness, and a modified cross section yarn having at least one indent on its perimeter like multi-filaments A is preferred to coordinate dry hand. Further, the polyester associated bundles of the present invention may further include other polyester fibers such as either or both of multi-filaments A and B containing metallic salt of 5-sodium sulfonic acid, copolymer of isophthalic acid and the like or inactive dust and the like, as required.

The associated bundles of the present invention are preferably twisted. However, when they are twisted too hard, it is difficult to obtain the difference of the length. Consequently, twisting is preferably not more than $25{,}000\sqrt{D}$, more preferably not more than $15{,}000\sqrt{D}$ (T/m), in which D is denier of the associated bundles. However, when softness is not required, it is not limited to this range.

The process for production of polyester associated bundles of the present invention will be explained.

Figure 2:
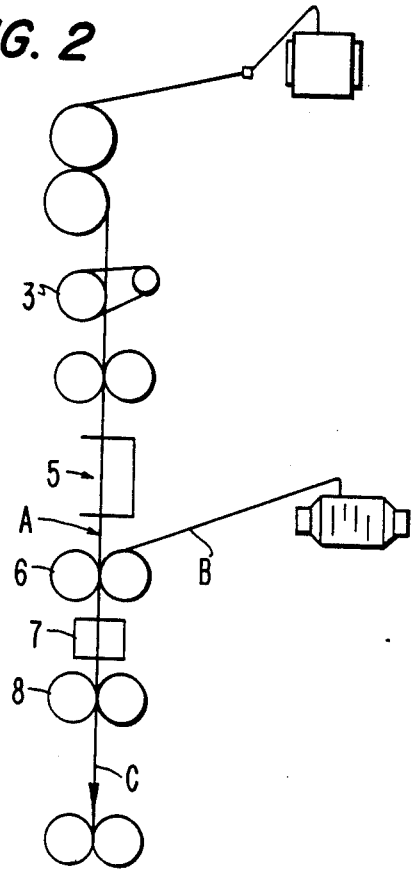
FIG. 2 is a schematic side view illustrating one example of an apparatus for producing the bundles wherein A is heat stretchable multi-filaments; B is heat shrinkable multi-filaments; C is the polyester associated bundles of the present invention; 3 is hot roller; 5 is noncontact heater and 7 is air-jet nozzle.

The schematic side view of one example of an apparatus for producing the polyester associated bundles of the present invention is illustrated in FIG. 2. In order to produce polyester multi-filament A excellent in spontaneous extensible characteristic, it is necessary to stretch unstretched yarn spun at the spinning rate of 1,500–4,000 m/min at a drawing temperature of Tg to Tg + 20° C. so as to obtain elongation at break of 30–45% and Δn of 0.10–0.14 after stretching. When the spinning rate is below 2,000 m/min, the physical properties after stretching are unstable and irregularities of thickness become large. On the other hand, when it exceeds 4,000 m/min, heat shrinkage and spontaneous extensible characteristic after stretching become low and desired feeling as woven or knitted fabric can not be obtained. Preferably, it is 2,000–4,000 m/min. The drawing temperature should be not lower than Tg of polyester multi-filament A in view of drawing stability. When it is higher than Tg + 20° C., crystallization proceeds and spontaneous extensible characteristic is lowered. The drawing temperature is important for providing spontaneous extensible characteristic. Elongation at break should be not less than 30% from the viewpoint of workability such as thread breakage during stretching. When extensibility at break is not less than 45%, unevenness of yarns is undesirably generated. In addition, Δn should be in the range of 0.10 –0.14. When it is out of this range, stability of spontaneous extensible characteristic obtained by relaxation heat treatment becomes insufficient. It is necessary to carry out the relaxation heat treatment using a non-contact heater for imparting spontaneous extensible characteristic at the heater temperature T (° C.) satisfying the following formulas (1) and (2) simultaneously and at overfeeding ratio of 20–60%:

$$75\log(\sqrt{D}\times V_y/HL)+4.7\sqrt{V_y}\geqq T\geqq 25\log(\sqrt{D\times V_y}/HL)+4.7\sqrt{V_y} \quad (1)$$

$$T\leqq Tm-10 \quad (2)$$

in which:

D: denier after relaxation $V_y$: velocity of relaxation draw-off roll (m/min)

HL: length of relaxation non-contact heater (m)

Tm: melting point (° C.)

$T_g$: second order translation point temperature (° C.).

Regarding spontaneous extensible characteristic, the present inventors have found that the heater temperature should have the relation of formula (1) with respect to denier, relaxation treatment rate and length of a non-contact type heater. When the heater temperature is higher than the range of formula (1), spontaneous extensible characteristic is lowered due to progress of crystallization and, when it is lower, generation of spontaneous extensible characteristic is diminished. It is required to simultaneously satisfy the requirements of formulas (1) and (2). However, when the heater temperature is higher than (Tm - 10) ° C., multi-filaments are molten due to heat of the heater while doffing is stopped, deteriorating re-starting ability. Therefore, it can not be applied industrially.

It is preferable that the velocity of a relaxation draw-off roll $V_y$ is 10–1,500 m/min and the length of a relaxation non-contact type heater HL is 0.1–2m.

The overfeeding ratio is preferably 20 -60% to obtain spontaneous extensible characteristic as well as stabilization of workability during the relaxation heat treatment. The heater should be non-contact type heater because roller lap up or thread breakage is caused by insufficient tension at the inlet of the heater due to running resistance of multi-filaments when a contact type heater is used.

Such polyester multi-filament A is combined and interlaced with different polyester multi-filaments at degree of interlacing of 20–100 interlacings m so as to obtain the denier ratio of 20–80% / 80–20%. The term "different polyester multi-filaments" used herein means, for example, filaments at least one of whose heat shrinkage characteristics such as SHW, SHD and the like is different from those of polyester multi-filament A.

To obtain woven or knitted fabric with good bulge, "hari", "koshi" and bulkiness derived from difference of length after dyeing and setting, polyester multi-filament B component should have wet shrinkage at 100° C. of not less than 5% and 160° C. SHD of not less than 7%. When both are lower than these limits, sufficient difference of filaments length can not be obtained and woven or knitted fabric with good feeling can not be obtained. The wet shrinkage at 100° C. is preferably 5–60%, more preferably 5–50%, and 160° C. SHD is preferably 5–80%, more preferably, 5–60%. Of course, polyester multi-filaments may be so-called thick and thin yarns or spontaneously extensible yarns. In the former case, SHW is preferably 5–30% and, in the latter case, 160° C. SHD is preferably not more than 0% and, in either case, difference in length from that of multi-filament A is preferably at least 5%.

In addition, it is important to combine filaments in a denier ratio of 20–80%. When spontaneously extensible polyester multi-filaments is less than 20%, insufficient bulge bulkiness is caused and, when it exceeds 80%, "hari" and "koshi" are deteriorated. The degree of interlacing should be 20–100 interlacings/m to obtain good handling properties of twisting, warping and weaving as well as to obtain uniform appearance made of woven and knitted fabric. When it is not more than 20/m, polyester multi-filament A is easily separated from polyester multi-filament B, deteriorating handling properties in the subsequent production steps. When it exceeds 100 /m, uniform appearance as woven and knitted fabric can not be obtained. By the constitution described above, the associated bundles of polyester multi-filaments A and B which are excellent in generation of spontaneous extensible characteristic and productivity can be obtained.

Then, the associated bundles may be further twisted. In this case, twisting is preferably not more than $25{,}000/\sqrt{D}$, more preferably not more than $15{,}000/\sqrt{D}$ (D: denier of the associated bundles). Of course, this additional twisting may not be effected.

The process for production of polyester fabric will be explained below.

Firstly, multi-filaments which show spontaneous extensible characteristic (hereinafter referred to as spontaneously extensible yarns) can obtained, for example, by stretching polyester unstretched yarns (preferably, unstretched yarns spun at high speed) without heat treatment, then subjecting to relaxation heat treatment at 160–250° C. Of course, the process for production of spontaneous extensible yarns is not limited to this. Dry heating treatment of the spontaneous extensible yarns at 160° C. provides spontaneous extensibility of 0–15% and, preferably, SHW is 0–5% and elongation at break is 50–100%. Subsequently, multi-filaments which shrink by heat (hereinafter referred to as heat shrinkable yarns) can be polyester multi-filaments obtained by conventional methods and have SHW of not less than 0%, preferably 5–60%. SHD is 5–80%, preferably 5–60%. Preferably, fracture tenacity is not less than 4 g/denier and elongation at break is preferably 25–40%. Further, in order to provide bulge and bulkiness, difference in SHD at 160° C. from that of the spontaneous extensible yarns is preferably 5–50%, more preferably, 10–35%. Further, the above heat shrinkable yarns may be so-called thick and thin yarns Considering balanced feeling, however, the single fiber denier is preferably 0.5–5 denier SHW is preferably within the range between 5 and 30%. When it is less than 5%, there may be caused problems in cost derived from limitation of facilities or deterioration of physical properties of yarns derived from stretching conditions. When it exceeds 30%, great difference in length can be obtained during post processing to provide apparent bulge of yarns, but thick and thin yarns are arranged completely in the core of the associated bundles, failing to show difference of color tone. Considering retention of physical properties of yarns after post processing, degree of orientation ($\Delta$ n) of the thin part is $15\text{–}60 \times 10^{-3}$, more preferably, $20\text{–}40 \times 10-3$ and that of the thick part is not less than $90 \times 10^{-3}$, more preferably not less than $160 \times 10^{-3}$. Generally, when thick and thin yarns are dyed,.they exhibit variable density, and there are drawbacks such as too excessive difference in density. In the associated bundles of the present invention, thick and thin yarns may be arranged in the inner layer by heat treatment, while spontaneously extensible yarns are arranged in the outer layer. Therefore, too excessive difference in density of thick and thin yarns is desirably masked, providing natural difference of color tone. It is necessary to interlace the above-described spontaneously extensible yarns and the heat shrinkable yarns. By simple combination of paralleled yarns, difference of physical properties of spontaneously extensible yarns and shrinking yarns is easily provides loops and such loops are caught on a guide and the like in the post processing such as additional twisting, doubling, warping, weaving and the like, which undesirably causes breakage of thread and the like. The "interlacing" herein is preferably the process wherein the spontaneously extensible yarns and the shrinkable yarns are combined and introduced to fluid turbulent area and subjected to interlacing treatment. The degree of interlacing (iL) is preferably 20–100 interlacings/m in view of handling properties of post processing such as additional twisting, warping, weaving and the like or to obtain uniform appearance of woven and knitted fabric. When it is less than 20/m, the spontaneously extensible polyester multi-filaments and the shrinkable polyester multi-filaments are easily separated, which deteriorates handling properties in the subsequent steps. When it exceeds 100/m, uniform appearance of woven and knitted fabric can not be obtained. Moreover, the spontaneously extensible yarns and the heat shrinkable yarns can be preferably combined at a denier ratio of (20/80)%–(80/20)% because, when the content of spontaneously extensible yarns is less than 20%, bulge or bulkiness characteristic of the spontaneously extensible yarns becomes insufficient and, when it exceeds 80%, the products lose "hari" and "koshi".

Preferably, the spontaneous extensible yarns and/or the shrinkable yarns have modified cross section, i.e., having at least one indent in the perimeter thereof from the view point of dry touch. It is preferable to contain dust such as $TiO_2$ from the viewpoint of dull effect, dyeing property and dry touch because such dust forms fine pores after alkali reduction. Further, it is preferred to use yarns in the form of hollow yarns from the viewpoint of bulkiness, temperature maintenance and the like. As needed, those are preferably used in combination thereof.

Further, it is preferable to use polyester fibers copolymerized with metallic salt of sulfonic acid and the like, as needed.

It is preferred to additionally twist the associated multi-filaments of the present invention because the spontaneously extensible yarns and the shrinkable yarns have great difference in dyeing and simple interlacing is apt to cause moire and unevenness due to difference in dyeing. Further, the extensible yarns irregularly protrude on the surface of the fabric to slightly make the surface irregular and deteriorate quality and the degree of interlacing is lowered by tension during warping, sizing and weaving step, which results in generation of many loops and deterioration of weaving.

Number of additional twisting is preferably $1{,}100 \leqq K \leqq 6{,}000$ or $7{,}000 \leqq K \leqq 25{,}000$.

$$\text{Number of additional twisting } (T/m) = K/\sqrt{\text{(denier of the composite filament yarns)}}$$

in which K is twisting coefficient.

Then, the product is set. When the number of additional twisting is $1{,}100 \leqq K \leqq 6{,}000$, sizing and drying are conducted. When it is $7{,}000 \leqq K \leqq 25{,}000$, twist setting is conducted. In this case, both treatments are preferably conducted at the temperature below 85° C.

Further, twist setting is preferably conducted at the temperature below 70° C. The reason for setting at low temperature will be shown below.

(1) By dry heat treatment during a sizing step, crystallization of fibers proceeds, which reduces spontaneously extensible characteristic to be obtained in weaving and dying process. Thus, sufficiently expanded fabric can not be obtained.

(2) Difference of length of yarns is generated by dry heat treatment during a sizing step, which deteriorates weaving properties.

The temperature of sizing is preferably between room temperature and 50° C., and drying is preferably carried out at not higher than 75° C. As a sizing agent, a conventional acrylic sizing agent can be used. As a sizing machine, a cylinder type machine such as that manufactured by Tsudakoma K.K. or Kohmoto Seiki K.K. in Japan can be used. The temperature of a first chamber is about 70° C. and that of a second chamber is about 75° C. The draft in the chamber is preferably low. Preferably, it is 0.1–0.2 g/d.

Of course, any other method can be employed so far as cold setting effect can be obtained Thus associated multi-filaments thus obtained can be used as warp and/or weft and woven according to conventional methods. Shuttleless looms such as water jet looms and the like are preferred because fluff is apt to be readily and inevitably generated during running of shuttle when a shuttle loom is used.

The fabric thus obtained can be subjected to heat treatment (at 110–200° C.) in the conventional post treatment and the like to provide soft fabric with good feeling and rich in expansion.

The following Examples further illustrate the present invention in detail but are not to be construed to limit the scope thereof.

In the Examples, determination of properties was conducted as follows:

(1) Elongation at break

By using Tensilon manufactured by Toyo Boldwin, K.K. in Japan, according to JIS-L-1013 (1981), a S-S curve of fiber was measured under the conditions of a sample length (gauge length) of 200 mm and rate of elongation of 200 mm/min and elongation at break was calculated.

(2) Wet shrinkage at 100° C. (SHW) and dry shrinkage at 160° C. (SHD)

According to JIS-L-1073, determination was conducted as follows.

By using a lap reeler having proper yoke perimeter at initial load of 1/10 g/denier, hank (8 winds) was taken. The weight of 1/30 g/denier was placed on the hank as a load and the length $l_0$ (mm) was measured. Then, the weight was removed and the hank with a weight of 1/1,000 g/denier was immersed in boiling water for 30 minutes. After that, the hank was removed from the boiling water, cooled and a weight was placed again (1/30 g/denier) as a load, and the length $l_1$ (mm) was measured. Then, after drying at 60 ° C for 30 minutes, the sample with a weight of 1,000 g/denier was subjected to heat treatment in an oven at 160° C. under dry heat conditions. After cooling, a weight of 1/30 g/denier was placed again and the length 12 (mm) was measured. Wet shrinkage at 100° C. (SHW) and dry shrinkage at 160° C. (SHD) were calculated using the following formulas:

$$SHW = \frac{(l_0 - l_1)}{l_0} \times 100$$

$$SHD = \frac{(l_0 - l_1)}{l_0} \times 100$$

(3) Degree of interlacing

Fibers of suitable length were taken and a weight (1/10 g/denier) was placed at its lower end and hung perpendicularly. A suitable needle was put into the yarn and slowly lifted up. The distance necessary for lifting the weight 1 (cm) was measured 100 times and the average 1 (cm) was determined and used for calculation by the following formula:

$$\text{Degree of slip} = \frac{100}{2 \times 1}$$

EXAMPLES 1 AND 2 AND REFERENCE EXAMPLE 1-8

The conventional polyester heat extensible multi-filaments were obtained according to the conventional method with changing spinning taking-up speed and spinning discharge, drawing ratio, relaxation ratio, relaxation temperature and setting time so that denier, DE, SHW, SHD after stretching - relaxation became as shown in Table 1. As the heat shrinkable multi-filaments, the commercially available Toyobo ester (manufactured by Toyo Boseki K.K. in Japan) were used and processed using the stretching-relaxation apparatus as shown in FIG. 2. As air nozzle 7, air jet FG17 manufactured by Fiber Guide was used, and air pressure and feed ratio between feed roll 6 and delivery roll 8 were controlled so that the objective degree of interlacing was obtained Physical properties of raw yarns used and quality of the resulting associated yarns as well as feeling of cloth obtained after twisting of the fiber yarns according to the conventional methods, weaving de Chine and dyeing it were evaluated. Further, general evaluation from the viewpoint of processability and feeling were conducted. The results are shown in Table 1.

Examples 1 and 2 which were within the scope of the present invention, showed good feeling and processability. In Reference Example 1, SHW of heat extensible multi-filaments was a negative value (i.e., heat extensible), and loops were generated during sizing. Further during weaving, shedding became bad and problems in processability were caused. In Reference Example 2, heat extensible multi-filaments did not shrink and, therefore, there were no loops protruding on the surface of the cloth. Thus, feeling similar to that of the conventional composite filament yarn with different shrinkage was obtained. In Reference Example 3, since the heat extensible multi-filaments had low elongation at break i.e., 40%, surface touch was rough and bad. In Reference Example 4, since the heat extensible multi-filaments had high elongation at break, i.e., 50%, that of the associated yarns was also high and unevenness was generated by tension and puckering was generated in cloth. In Reference Example 5, the ratio of heat extensible multi-filaments (the ratio to the denier of the associated yarns) was low, i.e., 18%, tenacity of the associated yarns was low , which resulted in breakage of threads as well as insufficient feeling, "hari" and "koshi". In Reference Example 6, the ratio of the heat extensible filaments was high, i.e., 90%, there were less heat shrinkable filaments protruding on the surface of the cloth, providing inferior expansion and bulkiness. In Reference Example 7, since the degree of interlacing was low, fibers were split and processability was bad. In Reference Example 8, the degree of interlacing was high, i.e., 130, there was moire mark called "interlacing mark" generated on the cloth.

TABLE 1

| | | Heat Extensible Multi-filament | | | | | | | Heat Shrinkable Multi-filament | | | | | | |
|---|---|---|---|---|---|---|---|---|---|---|---|---|---|---|---|
| No. | | D | Fil | DT | DE | SHW | SHD | Shape of cross section | D | Fil | DT | DE | SHW | SHD | Ratio |
| Ex. | 1 | 29 | 18 | 3.2 | 76 | 1.0 | −4.0 | c | 30 | 18 | 5.5 | 31.0 | 14.0 | 18.0 | 50 |
| | 2 | 29 | 18 | 3.2 | 76 | 1.0 | −4.0 | c | 73 | 36 | 5.2 | 35.0 | 13.0 | 16.0 | 71 |
| Ref. Ex. | 1 | 30 | 18 | 2.8 | 85 | −5.0 | −8.0 | c | 30 | 18 | 5.5 | 31.0 | 14.0 | 17.0 | 50 |
| | 2 | 30 | 18 | 3.5 | 55 | 3.0 | 5.0 | c | 30 | 18 | 5.0 | 38.0 | 20.0 | 27.0 | 50 |
| | 3 | 30 | 15 | 3.4 | 40 | 1.0 | −0.5 | c | 30 | 18 | 5.5 | 31.0 | 14.0 | 18.0 | 50 |
| | 4 | 29 | 18 | 3.2 | 76 | 1.0 | −4.0 | c | 30 | 18 | 4.8 | 50.0 | 16.0 | 23.0 | 50 |
| | 5 | 70 | 24 | 3.3 | 75 | 1.0 | −4.0 | c | 15 | 9 | 5.3 | 33.0 | 15.0 | 19.0 | 18 |
| | 6 | 15 | 10 | 3.4 | 71 | 1.5 | −3.5 | c | 135 | 48 | 5.2 | 35.0 | 15.0 | 20.0 | 90 |
| | 7 | 29 | 18 | 3.2 | 76 | 1.0 | −4.0 | c | 30 | 18 | 5.5 | 31.0 | 14.0 | 18.0 | 50 |
| | 8 | 29 | 18 | 3.2 | 76 | 1.0 | −4.0 | c | 30 | 18 | 5.5 | 31.0 | 14.0 | 18.0 | 50 |

| | | Associated Yarns | | | | | | | |
|---|---|---|---|---|---|---|---|---|---|
| No. | | ΔSHD | Degree of Interlacing | D | DT | DE | Feeling of Cloth | Processability | Synthetic Judgement |
| Ex. | 1 | 22.0 | 52 | 59.5 | 3.1 | 31 | a | a | a |
| | 2 | 20.0 | 55 | 102.5 | 3.4 | 30 | a | a | a |
| Ref. Ex. | 1 | 25.0 | 50 | 60 | 3.0 | 30 | c | c | b |
| | 2 | 22.0 | 53 | 60 | 3.3 | 43 | c | c | b |
| | 3 | 18.5 | 55 | 60 | 3.0 | 28 | c | b | b |
| | 4 | 27.0 | 55 | 60 | 3.1 | 48 | c | c | b |
| | 5 | 23.0 | 55 | 85 | 2.0 | 26 | c | c | b |
| | 6 | 23.5 | 55 | 150 | 3.3 | 32 | d | b | c |
| | 7 | 22.0 | 10 | 59.5 | 3.2 | 33 | c | c | b |

TABLE 1-continued

| | | | | | | | | | |
|---|---|---|---|---|---|---|---|---|---|
| | 8 | 22.0 | 130 | 60 | 3.3 | 30 | c | b | b |

Note of Table 1:
D: total denier
Fil: number of filaments
Shape of cross section: triangle shown in FIG. 3, 1
Feeling of cloth: evaluated by ten panelists by organoleptic test using a four-point scale
a: excellent in all of softness, "hari", "koshi" and drape
b: deficient in softness
c: deficient in softness and drape
d: starchy
Processability: operation rate of weaving machine
a: >98%
b: >95%
c: >90%
d: <90%
Synthetic judgements: evaluated for feeling of cloth and processability
a: excellent in both
b: inferior in either or both
c: extremely inferior in both

EXAMPLES 3-7 AND REFERENCE EXAMPLES 9-11

According to the conventional methods, polyethylene terephthalate having intrinsic viscosity of 0.63 was spun with a spinning nozzle having 18 holes by changing spinning rate and output to obtain unstretched yarns shown in Table 2. Then, associated filament yarns were prepared under the conditions shown in Table 3, and weaving and dyeing were conducted according to the conventional methods. Stretching, workability, relaxation heat treatment workability as processability, processability of post treatment such as weaving as well as feeling and appearance of fabric were evaluated. The results are shown in Table 3. For preparation of associated filament yarns, stretching, relaxation, a composite machine shown in FIG. 2 was used. To control degree of interlacing, air jet FG-1 manufactured by Fiber Guide was used and air pressure and treatment tension were controlled.

Examples 3-7 which were included in the scope of the present invention showed excelled processability, appearance and feeling of fabric. In Reference Examples 10 and 11 elongation at break was outside of the present invention. In Reference Example 10, elongation at break after stretching was high and irregularities of thickness were generated after stretching and feeling and uniformity of appearance of fabric were insufficient. In Reference Example 11, elongation at break after stretching was low and Δn are also outside of the present invention and, therefore, stretching workability was bad, which deteriorated processability In Reference Examples 12 and 13, relaxation heat treatment temperature was outside of the present invention. In Reference Example 12, relaxation heat treatment temperature was low and spontaneous extensibility was insufficient, and further feeling of fabric was insufficient. In Reference Example 13, relaxation heat treatment was high and melt breakage of thread was generated during stop of doffing, which provided slightly insufficient feeling of fabric. In Reference Examples 14 and 15, overfeeding ratio during relaxation heat treatment was outside of the present invention. Reference Example 14 provided insufficient feeling caused by deficient spontaneous extensibility. In Reference Example 15, overfeeding ratio was high and relaxation heat treatment workability deteriorated, which provided associated filament yarns with many loops and resulted in deficient processability in post treatment and insufficient feeling of fabric. In Reference Examples 16 and 17, combined filament denier ratio of spontaneously extensible multi-filaments and heat treated multi-filaments was outside of the present invention. In Reference Example 16, the ratio of heat shrinkable multi-filament was high and softness of fabric was insufficient. In Reference Example 17, the ratio of the heat shrinkable multi-filaments was low and "hari" and "koshi" were insufficient.

TABLE 2

| No. | Spinning Rate | Discharge (g/min) | Den |
|---|---|---|---|
| A | 3,000 | 10.6 | 32 |
| B | 3,000 | 9.0 | 27 |
| C | 3,000 | 12.3 | 37 |

TABLE 3

| No. | | Unstretched Yarns | Drawing Temp. (°C.) | Drawing Ratio | After stretching: Elongation at break | After stretching: Δ n | Relaxation Heat Treatment: $V_y$ (m/min) | iL (m) | Den | T (°C.) | Overfeeding Ratio (%) |
|---|---|---|---|---|---|---|---|---|---|---|---|
| Ex. | 3 | A | 80 | 1.60 | 35 | 0.12 | 300 | 0.3 | 30 | 220 | 50 |
| | 4 | A | 80 | 1.60 | 35 | 0.12 | 300 | 0.3 | 30 | 220 | 50 |
| | 5 | A | 80 | 1.60 | 35 | 0.12 | 300 | 0.5 | 30 | 230 | 50 |
| | 6 | A | 80 | 1.60 | 35 | 0.12 | 500 | 0.5 | 26 | 230 | 30 |
| | 7 | A × 2 | 80 | 1.60 | 35 | 0.12 | 300 | 0.5 | 60 | 240 | 50 |
| Ref. Ex. | 9 | A | 80 | 1.60 | 35 | 0.12 | 300 | 0.3 | 30 | 220 | 50 |
| | 10 | B | 80 | 1.35 | 43 | 0.10 | 300 | 0.3 | 30 | 220 | 50 |
| | 11 | C | 80 | 1.85 | 28 | 0.15 | 300 | 0.3 | 30 | 220 | 50 |
| | 12 | A | 80 | 1.60 | 35 | 0.12 | 300 | 0.3 | 28 | 170 | 40 |
| | 13 | A | 80 | 1.60 | 35 | 0.12 | 300 | 0.3 | 30 | 265 | 50 |
| | 14 | A | 80 | 1.60 | 35 | 0.12 | 300 | 0.3 | 22 | 220 | 10 |
| | 15 | A | 80 | 1.60 | 35 | 0.12 | 300 | 0.3 | 34 | 220 | 70 |
| | 16 | A | 80 | 1.60 | 35 | 0.12 | 300 | 0.3 | 30 | 220 | 50 |
| | 17 | A × 2 | 80 | 1.60 | 35 | 0.12 | 300 | 0.5 | 64 | 240 | 60 |

| | Combined filaments shrinkable componet | Degree of Interlac- | Drawing Work- | Relaxation Work- | Post treatment Process- | Feeling of | Appearance | Synthetic |
|---|---|---|---|---|---|---|---|---|

TABLE 3-continued

| No. | | Den/sil | SHW(%) | SHD(%) | ing | ability | ability | ability | Fabric | of Fabric | Estimation |
|---|---|---|---|---|---|---|---|---|---|---|---|
| Ex. | 3 | 30/18 | 14 | 18 | 40 | a | a | a | a | a | a |
| | 4 | 75/36 | 10 | 13 | 50 | a | a | a | a | a | a |
| | 5 | 30/18 | 14 | 18 | 35 | a | a | a | a | a | a |
| | 6 | 30/18 | 14 | 18 | 35 | a | a | a | a | a | a |
| | 7 | 20/9 | 7 | 10 | 60 | a | a | a | a | a | a |
| Ref. EX. | 9 | 30/18 | 14 | 18 | 40 | c | b | b | a | c | b |
| | 10 | 30/18 | 14 | 18 | 40 | b | b | b | c | c | b |
| | 11 | 30/18 | 14 | 18 | 40 | d | c | c | b | a | c |
| | 12 | 30/18 | 14 | 18 | 40 | a | b | b | d | a | c |
| | 13 | 30/18 | 14 | 18 | 40 | a | c | a | b | a | b |
| | 14 | 30/18 | 14 | 18 | 40 | a | a | a | d | a | c |
| | 15 | 30/18 | 14 | 18 | 40 | a | d | d | c | b | c |
| | 16 | 150/48 | 10 | 13 | 50 | a | a | a | d | a | c |
| | 17 | 15/9 | 7 | 10 | 40 | a | a | a | d | c | c |

Note of Table 3:
Den: total denier
fil: number of filaments

| | a | b | c | d |
|---|---|---|---|---|
| Drawing workability: breakage of drawn fibers: | ≦2% | ≦5% | ≦10% | ≧11% |
| Relaxation workability: breakage of drawn fibers: | ≦2% | ≦5% | ≦10% | ≧11% |
| After-treatment processability: (operation rate of weaving machine) | ≧98% | ≧95% | ≧90% | <90% |

Feeling of cloth: evaluated by ten panelists using four-point score
a: excellent in all of softness, "hari", "koshi" and drape
b: deficient in softness
c: deficient in softness and drape
d: starchy
Appearance of woven fabric: evaluated by a cloth inspecting machine for drawbacks using four-point scale
a: not observed
b: slightly observed
c: distinct
d: extremely distinct
Synthetic evaluation: synthetic evaluation of processability, workability, feeling and appearance of cloth
a: good
b: bad
c: extremely bad

EXAMPLES 8 AND 9 AND REFERENCE EXAMPLES 18 AND 19

Polyester semi-bright tips were used and spun using a spinneret having Y-openings and 18 nozzle holes at the spinning temperature of 289° C., and taken up at taking-up speed of 3,000 m/min. These unstretched yarns were used and stretched at hot roller temperature of 80° C. and drawing ratio of 1.65 times, and subjected to relaxation heat treatment while relaxation heat treatment temperature was changed as shown in Table 4 to obtain stretched yarns (finished yarns) with different stretching properties (30 denier, 18 filaments). These finished yarns were combined by interlacer nozzle under air pressure of 3 kg/m$^2$G. The combined yarns (60 denier, 36 filaments) were twisted (S twist, 450/m) and used as warp. Using hard twisted semidull polyester yarns (75 denier, 72 filaments) obtained by the conventional methods (S, Z twist, 3,000/m) as weft, crepe de Chine was woven using a water-jet loom (Warp density: 163/inch, weft density: 91/inch and width of 44'), and after conventional post treatment, the product was processed and evaluated. The results are shown in Tables 4 and 5.

Examples 8 and 9 provided completely novel type silky fabrics which were excellent in surface tough, feeling, "hari", "koshi", drape, bulkiness. On the other hand, Reference Example 18 provided product wherein stretching properties of the two components were free from problems but difference in stretching ratio was too small, i.e., 3%. Thus, the characteristics of the yarns were not sufficiently exhibited. Reference Example 19 provided associated filament yarns wherein yarns having the same stretching ratio and simply having stretching properties were paralleled and extremely inferior in surface properties, "hari", "koshi" and bulkiness. Accordingly, they can not be used as commercial products.

TABLE 4

| | Example | | | | Reference Example | | | |
|---|---|---|---|---|---|---|---|---|
| | 8 | | 9 | | 18 | | 19 | |
| Componet | 1 | 2 | 1 | 2 | 1 | 2 | 1 | 2 |
| Conditions of Relaxation heat treatment | | | | | | | | |
| Relaxation Ratio (%) | 60 | 40 | 40 | 40 | 40 | 40 | 50 | 50 |
| Heater Temperature (°C.) | 280 | 220 | 250 | 220 | 240 | 220 | 220 | 220 |
| Physical Properties of Raw Fibers | | | | | | | | |
| Drawing Ratio (%) | 15 | 3 | 10 | 3 | 6 | 3 | 4 | 4 |
| Difference in Drawing Ratio (%) | 12 | | 7 | | 3 | | 0 | |
| Properties of Fabrics | | | | | | | | |
| Surface Touch | a | | a | | b | | d | |
| Feeling | a | | a | | b | | c | |
| Hari and Koshi | b | | b | | c | | d | |
| Drape | a | | a | | c | | c | |
| Bulkiness | a | | b | | c | | d | |
| Synthetic | a | | a | | c | | d | |

TABLE 4-continued

| | Example | | | | Reference Example | | | |
|---|---|---|---|---|---|---|---|---|
| | 8 | | 9 | | 18 | | 19 | |
| Componet | 1 | 2 | 1 | 2 | 1 | 2 | 1 | 2 |
| Evaluation | | | | | | | | |

TABLE 5

| | Evaluation | | | |
|---|---|---|---|---|
| | a | b | c | d |
| Surface touch | Excellent in touch like a surface of peach | Slightly inferior in peach-skin | Far from peach-skin touch | Hard touch |
| Feeling | Excellent in dry touch | Slightly deficient in dry touch | Far from having dry touch | Flabby |
| Hari and Koshi | Excellent in Hari | Slightly deficient in Hari | Deficient in body | Limp |
| Drape | Excellent in drape | Slightly deficient in drape | Deficient in drape | Starchy |
| Bulkiness | Extremely rich in bulkiness | Slightly deficient in bulkiness | Far from having bulkiness | Deficient in bulkiness |
| Synthetic Evaluation | The scores of the above five items were generally evaluated | | | |

By using a 24-hole nozzle having Y-opening at 289° C. with changing the amount of discharge, spinning was carried out and the product was taken up at the rate of 2,200 m/min. The unstretched yarns were used and unevenly drawn to obtain thick and thin yarns having denier shown in Table 8. SHW of the thick and thin yarns was 13%, and a $\Delta$ n of the thick part was $25 \times 10^{-3}$ and that of the thin part was $150 \times 13^{-3}$. By using a 36-hole nozzle having Y-opening at 289° C. with changing the amount of discharge, spinning was carried out and the product was taken up at the rate 3,00 m/min. The unstretched yarns were stretched at hot roller temperature of 80° C. and drawing ratio of 1,65 times and then subjected to relaxation heat treatment at the temperature of 230° C. and relaxation ratio of 40% to give drawn yarns having denier shown in Table 2. The stretched yarns had the draw ratio of 6%. The above thick and thin yarns and the stretched yarns were combined to 100 denier in total and combined under air pressure of 3.0 kg/cm$^2$G by an interlacer nozzle to obtain associated filament yarns (100 denier, 60 filaments). The resulting associated filament yarns were twisted (S 250/m) and used as warp, 200 denier, 144 filaments semi-dull yarns (S-Z 1,500/m) as weft were alternatively inserted and faille (warp density: 140/inch, weft density: 71/inch) was woven, dyed and finished and evaluated. The products according to the present invention (Examples 13, 14 and 15) provided completely novel type of silky fabrics which were excellent in feelings and bulkiness, having desired degree of "hari" and "koshi" and showing natural color tone. On the contrary, the product of Reference Example 22 had small combination ratio of thick and thin yarns, deficient in contrast of density, deficient in body and tension, and provided soft feeling because of large combination ratio of stretching yarns. Reference Examples 23 provided product with large combination ratio of thick and thin yarns, too strong contrast of density and hard feeling.

TABLE 6

| | Example | | | | | | | | Reference Example | | | |
|---|---|---|---|---|---|---|---|---|---|---|---|---|
| | 10 | | 11 | | 12 | | | | 20 | | 21 | |
| Component | A | B | A | B | A | B | | | A | B | A | B |
| Physical Properties or Raw Fibers | | | | | | | | | | | | |
| Wet shrinkage at 100° C. (%) | 5 | — | 10 | — | 20 | — | | | 20 | — | 20 | — |
| Extending by Dry Heat (%) | — | 15 | — | 5 | — | 0 | | | — | −2 | — | −2 |
| Alkali Reduction (%) | 15 | | 15 | | 15 | | | | 15 | | 25 | |
| Properties of Fabrics | | | | | | | | | | | | |
| Feeling | a | | a | | a | | | | d | | a | |
| Contrast of Density | a | | a | | a | | | | c | | c | |
| Drape | a | | a | | a | | | | d | | c | |
| Bulkiness | a | | a | | a | | | | d | | d | |
| Hari and Koshi | a | | a | | a | | | | b | | a | |
| Weariness | a | | a | | a | | | | d | | d | |
| Treating Strength (g) | 1,000 | | 1,000 | | 1,000 | | | | 1,000 | | 400 | |

Component A: thick and thin yarns, B: Stretching yarns
Tearing strength: tearing strength along crosswise direction

TABLE 7

| Evaluation | a | b | c | d |
|---|---|---|---|---|
| Feeling | having peach-skin touch and excellent in dry touch | Slightly deficient in dry touch | Far from having peach-skin touch and deficient in dry touch | Hard touch |
| Contrast in Density | Natural | — | Slightly strong | Almost no contrast observed |
| Drape | Excellent in drape | Slightly deficient in drape | Deficient in drape | Starchy |
| Bulkiness | Extremely rich in bulkiness | Slightly deficient in bulkiness | Far from having bulkiness | Deficient in bulkiness |
| Body and Koshi | Excellent in in Hari | Slightly limp | Limp | Flabby |
| Weariness | Without weariness and bulkiness is retained | Slightly observed | Observed and deficient in bulkiness | Without bulkiness |

Ten panelists evaluated by organoleptic test and visual test using four-point scale.

TABLE 8

| | Example | | | | | | Reference Example | | | |
|---|---|---|---|---|---|---|---|---|---|---|
| | 13 | | 14 | | 15 | | 22 | | 23 | |
| Componet | A | B | A | B | A | B | A | B | A | 6 |
| Physical Properties or Raw Fibers | | | | | | | | | | |
| Denier/Filaments | 20/24 | 80/36 | 50/24 | 50/36 | 80/24 | 20/36 | 15/24 | 85/36 | 85/24 | 15/36 |
| Ratio by Weight (%) | 20 | 80 | 50 | 50 | 80 | 20 | 15 | 85 | 85 | 15 |
| Wet shrinkage | 13 | — | 13 | — | 13 | — | 13 | — | 13 | — |

TABLE 8-continued

| | Example | | | | | | Reference Example | | | |
|---|---|---|---|---|---|---|---|---|---|---|
| | 13 | | 14 | | 15 | | 22 | | 23 | |
| Componet | A | B | A | B | A | B | A | B | A | 6 |
| at 100° C. (%) | | | | | | | | | | |
| Extending by Dry Heat (%) | — | 6 | — | 6 | — | 16 | — | 16 | — | 16 |
| Alkali Reduction % | 15 | | 15 | | 15 | | 15 | | 15 | |
| Properties of Fabric | | | | | | | | | | |
| Feeling | Peach-skin touch and limp | | Peach-skin touch and limp | | Peach-skin touch and limp | | Too soft | | Too hard | |
| Contrast in Density | Mild and natural | | Natural | | Slightly distinct | | Almost no difference in density | | Too strong | |
| Hari and Koshi | Proper degree of koshi | | Proper degree of koshi | | Proper degree of koshi | | Deficient in koshi | | Too strong | |
| Bulkiness | Rich in bulkiness | | Rich in bulkiness | | Rich in bulkiness | | Rich in bulkiness | | Rich in bulkiness | |

Componet A: thick and thin yarns B: stretching yarns
Properties of fabrics (four items): evaluated by ten panelists by organoleptic test and visual test.

EXAMPLES b 16 AND 17, AND REFERENCE EXAMPLE 24–29

29 Denier-18 filament spontaneously extensible multi-filament (DT: 3.2 g/d, DE: 76 %, SHW: 1.0 %, 160° C. SHD: -4.0 %, cross sectional shape: triangle) and 30 denier-18 filament heat shrinkable multi-filament (DT: 5.5 g/d, DE: 31.0 %, SHW: 14.0 %, 160° C SHD: 18.0 %) were combined and interlaced at the denier ratio of 50/50 under the conditions shown in Table 9, subsequently, subjected to additional twisting and twist setting or sizing and drying. Thus obtained associated yarns were woven using a water jet loom (warp density: 160/inch, weft density: 100/inch) and dyed according to the conventional methods. The results are shown in Table 9.

TABLE 9

| | Example | | Reference Example | | | | | |
|---|---|---|---|---|---|---|---|---|
| | 16 | 17 | 24 | 25 | 26 | 27 | 28 | 29 |
| Condition | | | | | | | | |
| Interlacing | 50 | 50 | 50 | 50 | 0 | 150 | 50 | 50 |
| Additinal twisting | 450 | 1100 | 450 | 1100 | 450 | 450 | 450 | 0 |
| Setting temp. (° C.) | — | 60 | — | 90 | — | — | — | — |
| Sizing Agent | + | − | + | − | + | + | — | + |
| Sizing temp. (° C.) | 75 | — | 100 | — | 75 | 75 | — | 75 |
| Associated fiber loop | a | a | a | a | c | b | a | b |
| Breakage of twisted yarns | a | a | a | a | c | a | a | b |
| Operation rate of loom | a | a | a | a | b | a | c | a |
| Feeling of fabric | a | a | c | c | b | b | a | b |
| Uniformity of fabric | a | a | a | a | c | b | a | b |
| Synthetic Evaluation | a | a | c | c | c | b | c | b |

Note of Table 9:

| | a | b | c |
|---|---|---|---|
| Combined fiber loop: (Number on the surface of pirn) | ≦5 | ≦10 | ≧11 |
| Breakage of twisted yarns: | ≦2% | ≦5% | ≦6% |

TABLE 9-continued

| | Example | | Reference Example | | | | | |
|---|---|---|---|---|---|---|---|---|
| | 16 | 17 | 24 | 25 | 26 | 27 | 28 | 29 |
| Operation rate of loom: | | | | | ≧95% | ≧90% | | <90% |

Sizing Agent
+: sizing agent used
−: no sizing agent
Feeling of fabric: evaluated by ten panelists
a: excellent in softness, body, tension and drape
b: insufficient softness and drape
c: starchy
Uniformity of fabric: defects were evaluated by a cloth inspecting machine
a: not observed
b: distinct
c: extremely distinct

What is claimed is:

1. Potential bulky polyester associated bundles for woven or knitted fabric comprising multi-filament A and multi-filament B, wherein: said associated bundles are interlaced at a degree of interlacing of 20–100 interlaces/m; said associated bundles have a denier ratio of multi-filament A/multi-filament B of 20/80–80/20; said multi-filament A is composed of single fibers of not more than 3 denier; said multi-filament B has a fracture tenacity or to less than 4 g/denier; said multi-filament A has a wet shrinkage at 100° C., SHW (A), of 0 to 5%; said multi-filament B has a wet shrinkage at 100° C., SHW (B), of 5 to 60%; said multi-filament A has a dry shrinkage at 160° C., SHD (A), of −15 to 0%; and said multi-filament B has a dry shrinkage at 160° C., SHD (B), so that the difference of SHD (B) −SHD (A) is not less than 5%.

2. Potential bulky polyester associated bundles according to claim 1, wherein said difference of SHD (B)−SHD (A) is 10–35%.

3. Potential bulky polyester associated bundles according to claim 1, wherein said multi-filament A has an elongation at break of not less than 50%.

4. Potential bulky polyester associated bundles according to claim 3, wherein said elongation at break is not more than 80%.

5. Potential bulky polyester associated bundles according to claim 1, wherein said SHD (B) is 5–80%.

6. Potential bulky polyester associated bundles according to claim 1, wherein said multi-filament B has an elongation at break of not more than 40%.

7. Potential bulky polyester associated bundles according to claim 6, wherein said elongation at break is 25–40%.

8. Potential bulky polyester associated bundles according to claim 1, wherein said multi-filament A is a polyester multi-filament composed of modified cross-section fibers having at least one indent on the perimeter of the cross-section.

9. Potential bulky polyester associated bundles according to claim 1, wherein said multi-filament A has at least ten fibers.

10. Potential bulky polyester associated bundles according to claim 1, wherein the multi-filaments A and B form a substantial sheath-core structure having a sheath and a core, said multi-filament A being arranged in said sheath and said multi-filament B being arranged in said core.

11. Potential bulky polyester associated bundles according to claim 1, wherein said SHW (B) is 5–30%, the associated bundles having uneven thickness along the fiber axis of said multi-filament B.

12. Potential bulky polyester associated bundles according to claim 1, wherein said SHD (B) is 5–60%.

13. Potential bulky polyester associated bundles according to claim 1, wherein said SHW (B) is 5–50%.

14. A process for production of potential bulky polyester associated bundles for woven or knitted fabric, comprising:

obtaining multi-filament A having an elongation at break of 30–45% and a degree of orientation, Δn, of 0.10 to 0.14;

heat treating said multi-filament A by a relaxation heat treatment with a non-contact heater at an overfeeding ratio of 20–60% at a heater temperature, T, wherein $$75 \log(\sqrt{D \times V_y}\ /HL) + 4.7\sqrt{V_y} > T >$$

$$25 \log(\sqrt{D \times V_y}\ /HL) + 4.7\sqrt{V_y}$$

and $$T < T_m - 10,$$

with

D=denier after relaxation, $V_y$=velocity of relaxation draw-off roll (m/min),

HL=length of relaxation non-contact heater (m), and $T_m$=melting point (°C.); and combining said multi-filament A with multi-filament B at an interlacing of 20–100 interlacings/m so as to obtain a denier ratio of multi-filament A/multi-filament B of 20/80–80/20;

wherein said multi-filament A has a wet shrinkage at 100° C., SHW (A), of 0 to 5%, said multi-folament B has a wet shrinkage at 100° C., SHW (B), o 5 to 60%, said multi-filament A has a dry shrinkage at 160° C., SHD (A), of −15 to 0%, and said multi-filament B has a dry shrinkage at 160° C., SHD (B), so that the difference of SHD (B) −SHD (A) is not less than 5%.

15. A process according to claim 14, wherein said combining occurs successively after said heat treating.

16. A process according to claim 14, wherein said difference of SHD (B) −SHD (A) is 10–35%.

17. A process according to claim 14, wherein said SHD (B) is 5–80%.

18. A process according to claim 14, wherein said multi-filament B has an elongation at break of nor more than 40%.

19. A process according to claim 14, wherein said multi-filament A is a polyester multi-filament composed of modified cross-section fibers having at least one indent on the perimeter of the cross-section.

20. A process according to claim 14, wherein said multi-filament A has at least ten fibers.

21. A process according to claim 14, wherein said obtaining includes drawing unstretched multi-filament A at a spinning rate of 1,500–4,000 m/min at a drawing temperature of $T_g$ to $T_g$ + 20° C., wherein $T_g$=second-order transition point temperature (°C.), so as to obtain said multi-filament A having an elongation at break of 30–45% and a degree of orientation, Δn, of 0.10 to 0.14.

22. A process according to claim 14, wherein said combining includes arranging said multi-filaments A and B in a substantial sheath-core structure having a sheath and a core, said multi-filament A being arranged in said sheath and said multi-filament B being arranged in said core.

23. A process according to claim 14, wherein said SHD (B) is 5–60%.

24. A process according to claim 14, wherein said SHW (B) is 5–30% and said combining includes arranging said multi-filaments A and B so that the associated bundles have uneven thickness along the fiber axis of said multi-filament B.

25. A process according to claim 14, wherein said multi-filament B has an elongation at break of 25–40%.

26. A process for producing polyester fabric which comprises:

twisting associated multi-filament A and multi-filament B, wherein said multi-filament A is spontaneously heat extensible and has a wet shrinkage at 100° C., SHW (A), of 0 to 5% and a dry shrinkage at 160° C. SHA (A), of −15 to o%, multi-filament B is heat shrinkable and has a wet shrinkage at 100° C., SHW (B), of 5 to 60% and a dry shrinkage at 160° C., SHD (B), so that the difference of SHD (B) − SHD (A) is not less than 5%, and said multi-filaments A and B are interlaced at a degree of interlacing of 20–100 interlacings/m;

twist setting or sizing the associated multi-filaments A and B at a temperature not higher than 85° C.;

drying the twist-setted or sized associated multi-filaments A and B; and weaving the dried associated multi-filaments A and B with the multi-filaments A and B as warp or weft.

27. A process according to claim 26, further comprising:

additionally twisting the twisted associated multi-filaments A and B at a twisting coefficient, K, of 1,100 to 6,000.

28. A process according to claim 26, further comprising:

additionally twisting the twisted associated multi-filaments A and B at a twisting coefficient, K, of7,000 to 25,000.

29. A process according to claim 26, wherein said multi-filament A has an elongation at break of not less than 50%.

30. A process according to claim 29, wherein said elongation at break is not more than 80%.

31. A process according to claim 26, wherein said SHD (B) is 5–80%.

32. A process according to claim 26, wherein said multi-filament B has an elongation at break of not more than 40%.

33. A process according to claim 26, wherein said SHW (B) is 5–30% and said combining includes arranging said multi-filaments A and B so that the associated bundles have uneven thickness along the fiber axis of said multi-filament B.

34. A process according to claim 26, wherein said multi-filament A or multi-filament B has a modified cross-section with at least one indent on the perimeter of the cross-section.

35. A process according to claim 26, wherein said weaving includes weaving with a shuttleless loom.

36. A process according to claim 26, wherein said twist setting or sizing includes both twist setting and sizing.

37. A process according to claim 26, wherein said multi-filament B has an elongation at break of 25–40%.

38. A process according to claim 26, wherein said associated multi-filaments A and B have a denier ratio of multi-filament A/multi-filament B of 20/80–80/20.

* * * * *